US010224619B2

(12) United States Patent
Kim

(10) Patent No.: US 10,224,619 B2
(45) Date of Patent: Mar. 5, 2019

(54) ANTENNA DEVICE OF RADAR SYSTEM

(71) Applicant: LG INNOTEK CO., LTD., Seoul (KR)

(72) Inventor: Jong Guk Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 191 days.

(21) Appl. No.: 15/113,722

(22) PCT Filed: Jan. 22, 2015

(86) PCT No.: PCT/KR2015/000675
§ 371 (c)(1),
(2) Date: Jul. 22, 2016

(87) PCT Pub. No.: WO2015/111932
PCT Pub. Date: Jul. 30, 2015

(65) Prior Publication Data

US 2017/0005405 A1 Jan. 5, 2017

(30) Foreign Application Priority Data

Jan. 23, 2014 (KR) ..... 10-2014-0008215

(51) Int. Cl.
*H01Q 13/10* (2006.01)
*H01Q 1/32* (2006.01)
(Continued)

(52) U.S. Cl.
CPC ..... *H01Q 1/3283* (2013.01); *H01Q 1/3233* (2013.01); *H01Q 9/265* (2013.01);
(Continued)

(58) Field of Classification Search
CPC .. H01Q 1/3283; H01Q 1/3233; H01Q 21/068; H01Q 21/065
(Continued)

(56) References Cited

U.S. PATENT DOCUMENTS 6,031,491 A 2/2000 Daniel et al.
7,692,601 B2 * 4/2010 Bisiules ..... H01P 5/103 343/797
(Continued)

FOREIGN PATENT DOCUMENTS

KR 10-1999-0082640 A 11/1999
KR 10-2000-0008513 A 2/2000
(Continued)

OTHER PUBLICATIONS

International Search Report, issued in PCT/KR2015/000675, dated May 15, 2015.

*Primary Examiner* — Hai Tran
(74) *Attorney, Agent, or Firm* — Birch, Stewart, Kolasch & Birch, LLP

(57) ABSTRACT

The resent invention relates to an antenna device of a radar system, comprising: a substrate; multiple radiators arranged on the upper surface of the substrate; and multiple resonators arranged on the lower surface of the substrate and placed beneath the radiator, the resonators having the shape of rings having at least one slit formed thereon. According to the present invention, the radiators and the resonators operate together, thereby improving the performance of the antenna device.

10 Claims, 12 Drawing Sheets

(51) Int. Cl.
*H01Q 21/06* (2006.01)
*H01Q 9/26* (2006.01)
*H01Q 13/20* (2006.01)

(52) U.S. Cl.
CPC ..... *H01Q 13/206* (2013.01); *H01Q 21/065* (2013.01); *H01Q 21/068* (2013.01)

(58) Field of Classification Search
USPC ..... 343/767
See application file for complete search history.

(56) References Cited

U.S. PATENT DOCUMENTS

2005/0128144 A1 6/2005 Himmelstoss et al.
2008/0180333 A1* 7/2008 Martiskainen ..... H01Q 1/243 343/722
2009/0015496 A1* 1/2009 Liu ..... H01Q 9/0457 343/742
2010/0090903 A1 4/2010 Byun et al.
2012/0056790 A1* 3/2012 Lee ..... H01Q 7/00 343/702
2012/0229366 A1 9/2012 Ding

FOREIGN PATENT DOCUMENTS

KR 10-2008-0051435 A 6/2008
KR 10-1352000 B1 1/2014
KR 10-1389837 B1 4/2014

* cited by examiner (a)

| Name | Theta | Ang | Mag |
|---|---|---|---|
| m1 | -3.0000 | -3.0000 | 17.4892 |

(b)

| Name | Theta | Ang | Mag |
|---|---|---|---|
| m1 | -1.0000 | -1.0000 | 16.8917 |

ANTENNA DEVICE OF RADAR SYSTEM

CROSS REFERENCE TO RELATED APPLICATIONS

This application is the National Phase of PCT International Application No. PCT/KR2015/000675, filed on Jan. 22, 2015, which claims priority under 35 U.S.C. 119(a) to Patent Application No. 10-2014-0008215, filed in Republic of Korea on Jan. 23, 2014, all of which are hereby expressly incorporated by reference into the present application.

TECHNICAL FIELD

The present invention relates to a radar system, and more particularly to an antenna device of a radar system.

BACKGROUND ART

Generally, a radar system has been applied to various technical fields. Here, the radar system is mounted on a vehicle so that a mobility of the vehicle is improved. Such a radar system detects information on the surroundings of the vehicle using an electromagnetic wave. Further, as the vehicle uses the information for the movement thereof, its mobile efficiency may be improved. For this, the radar system includes an antenna device. That is, the radar system transmits and receives an electromagnetic wave through the antenna device. Here, the antenna device includes multiple radiators. Here, the radiators are formed in a certain size and shape.

However, the antenna device of the radar system has a problem that the performances of the radiators are not uniform. It is because environmental factors such as a loss rate occur differently in the antenna device depending on the location of the radiators. Additionally, the antenna device of the radar system has a problem that it has a limited detection coverage only. Due to this, it is difficult for the radar system having a single antenna device to detect information on a wide detection coverage. Also, when the radar system includes a number of antenna devices, the radar system may be enlarged in size and its cost may be increased.

INVENTION

Technical Problem

Accordingly, the present invention provides an antenna device for improving an operating efficiency of a radar system. That is, the present invention is provided to obtain a uniform performance of radiators in the radar system. Further, the present invention is provided to extend a detection coverage of a radar system without enlarging the radar system.

Technical Solution

An antenna device of a radar system according to the present invention to solve the above-described problem comprises a substrate; multiple radiators arranged on the upper surface of the substrate; and multiple resonators arranged on the lower surface of the substrate and placed beneath the radiator, the resonators having the shape of rings having at least one slit formed thereon.

In the antenna device according to the present invention, the multiple radiators may be formed according to weights that are established in advance, respectively.

In the antenna device according to the present invention, the resonators may have slits formed at locations that are determined according to the weights correspondingly to the radiators.

In the antenna device according to the present invention, the resonators may have two slits that are opposite each other.

In the antenna device according to the present invention, the weights may be established differently according to the locations of the radiators.

The antenna device according to the present invention may further comprise a feeding unit that is disposed in one side of the radiators on an upper surface of the substrate.

In the antenna device according to the present invention, the radiators may include a coupling unit disposed apart from the feeding unit, and a radiation unit connected to the coupling unit.

In the antenna device according to the present invention, the radiators may include a connection unit connected to the feeder, and a radiation unit connected to the connector.

In the antenna device according to the present invention, the resonators may surround the radiation unit.

Advantageous Effects

An antenna device of a radar system according to the present invention may have radiators that are formed according to their weights, respectively, thereby obtaining a uniform performance of the radiators. Specifically, a desired resonant frequency and radiation coefficient may be obtained for each radiator, and an impedance matching is performed. In addition, a variety of detection distances may be embodied in an antenna device. By doing this, a radar system may obtain a desired detection coverage, with an antenna device only. In other words, a detection coverage of a radar system may be expanded without enlarging the radar system. Accordingly, the performance of the radar system may be enhanced. Further, the production cost of the radar system may be reduced.

BEST MODE

Figure 1:
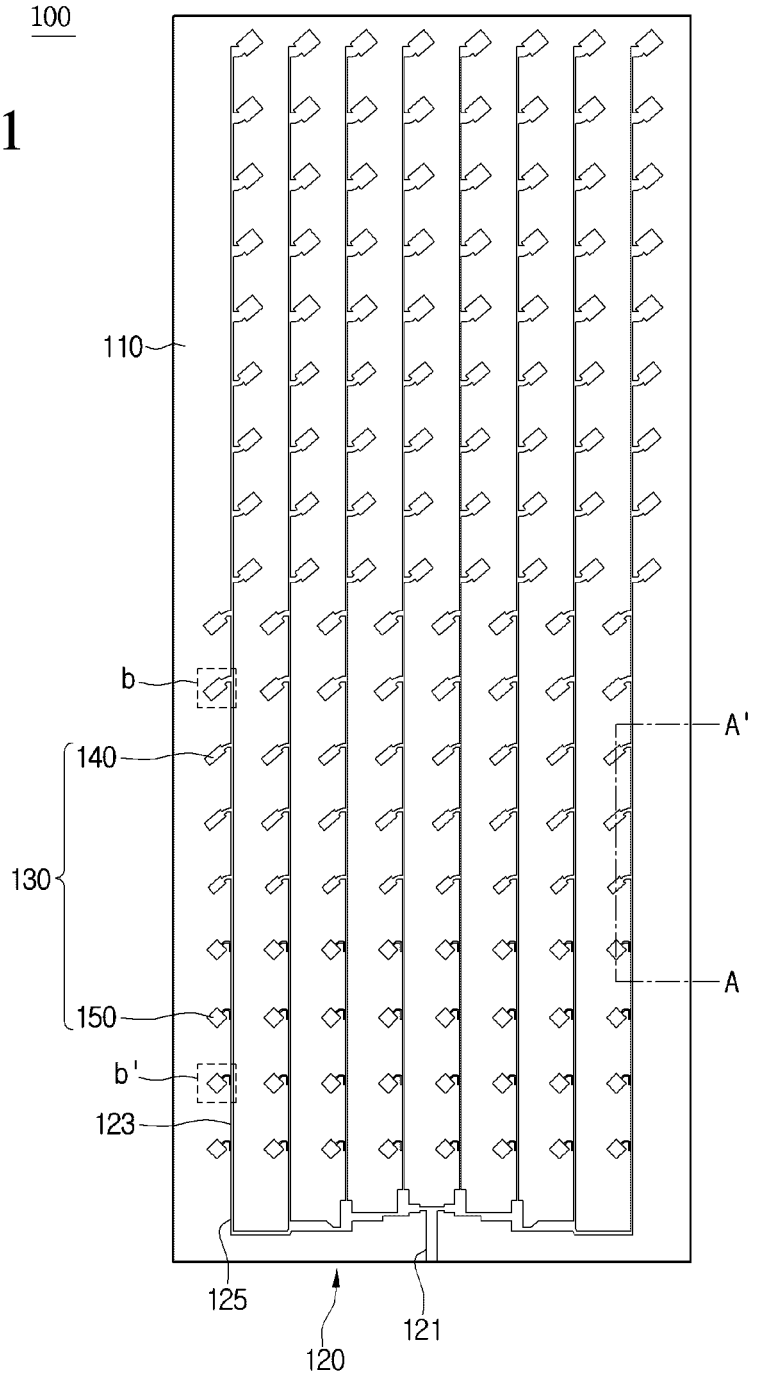
FIG. 1 is a plan view illustrating an antenna device of a radar system according to a first embodiment of the present invention.

Hereinafter, embodiments of the present invention will be described in more detail with reference to the accompanying drawings. Here, it is noted that the same element in the accompanying drawings is denoted as the same reference numeral as far as possible. The detailed description of known function and construction unnecessarily obscuring the subject matter of the present invention will be omitted.

Figure 2:
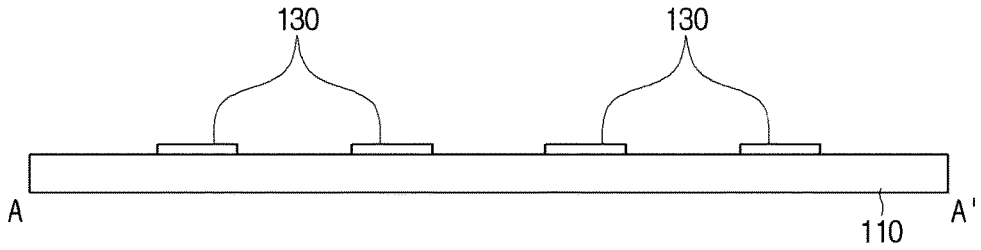
FIG. 2 is a cross-sectional view illustrating a cross-section cut along the line A-A' in FIG. 1.
Figure 3:
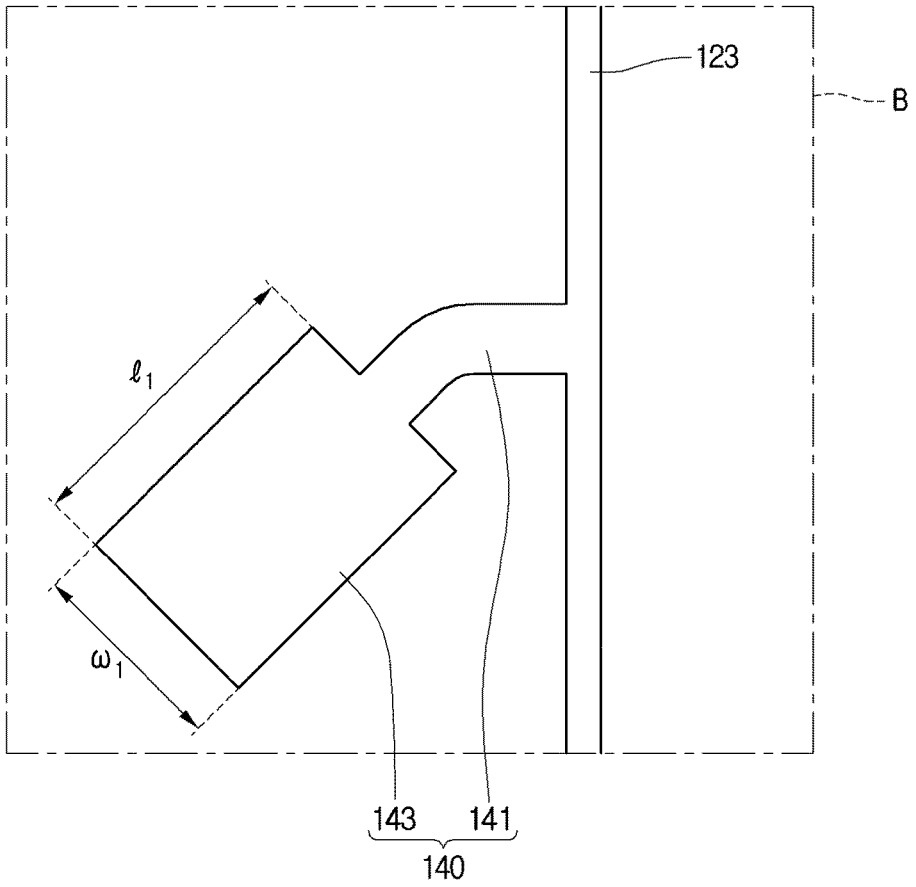
FIG. 3 is an enlarged view illustrating a B region in FIG. 1.
Figure 4:
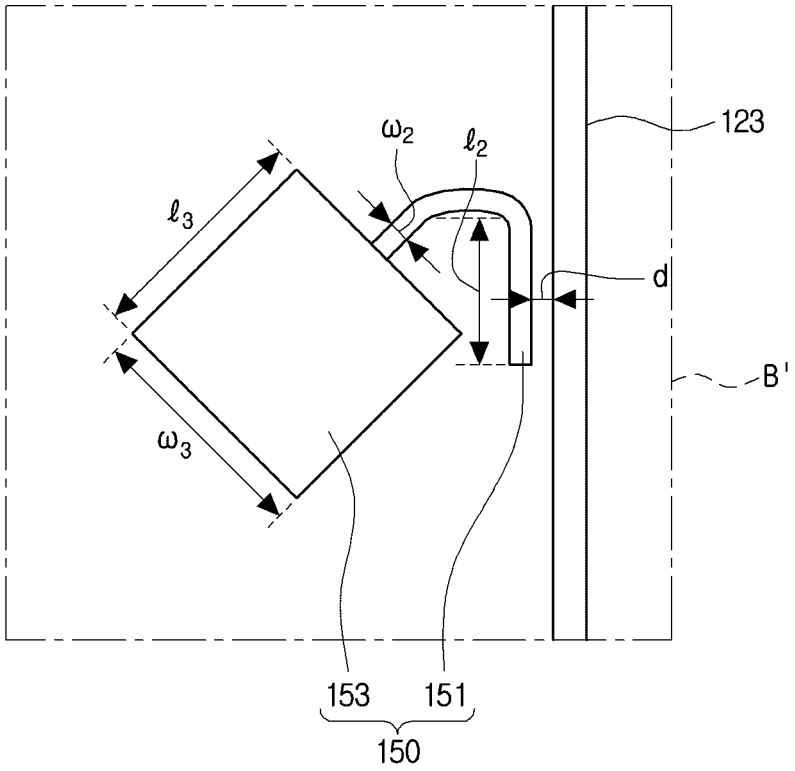
FIG. 4 is an enlarged view illustrating a B' region in FIG. 1.

FIG. 1 is a plan view illustrating an antenna device of a radar system according to a first embodiment of the present invention. And, FIG. 2 is a cross-sectional view illustrating a cross-section cut along the line A-A' in FIG. 1. Further, FIG. 3 is an enlarged view illustrating a B region in FIG. 1 and FIG. 4 is an enlarged view illustrating a B' region in FIG. 1.

Referring to FIGS. 1 to 4, an antenna device 100 of a radar system according to the present embodiment includes a substrate 110, a feeding unit 120, and multiple radiators 130.

The substrate 110 supports the feeding unit 120 and the radiators 130. Here, the substrate 110 has a flat structure. Here, the substrate 110 may have a multi-layer structure. Further, the substrate 110 is made of a dielectric material. Here, the conductivity $\sigma$ of the substrate 110 may be 0.02. Also, the permittivity $\in$ of the substrate 110 may be 4.4. Further, the loss tangent of the substrate 110 may be 0.02.

The feeding unit 120 supplies a signal to the radiators 130 in the antenna device 100. Further, the feeding unit 120 is disposed on the upper surface of the substrate 110. Here, the feeding unit 120 is connected to a control module (not illustrated). Also, the feeding unit 120 receives a signal from the control module and supplies the signal to the radiators 130. Here, a feed point is defined in the feeding unit 120. That is, the feeding unit 120 receives the signal through the feed point 121. Further, the feeding unit 120 is made of a conductive material. Here, the feeding unit 120 may include at least any one of silver (Ag), palladium (Pd), platinum (Pt), copper (Cu), gold (Au) and nickel (Ni). The feeding unit 120 includes a number of feed lines 123 and a distributor 125.

The feed lines 123 may extend in one direction. Further, the feed lines 123 are arranged parallel to one another in another direction. Here, the feed lines 123 are disposed apart one another at a predetermined interval. Further, a signal is delivered from one end to the other end in each feed line 123.

The distributor 125 connects the feed point 121 and the feed lines 123 each other. Here, the distributor 125 is extended from the feed point 121. Further, the distributor 125 is connected to each feed line 123. Also, the distributor 125 supplies a signal from the feed point 121 to the feed lines 123. Here, the distributor 125 distributes the signal to the feed lines 123.

The radiators 130 emit a signal from the antenna device 100. That is, the radiators 130 form a radiation pattern of the antenna device 100. Further, the radiators 130 are disposed on the upper surface of the substrate 110. Here, the radiators 130 are distributively disposed in the feeding unit 120. Here, the radiators 130 are arranged along the feed lines 123. By doing this, a signal is supplied from the feeding unit 120 to the radiators 130. Also, the radiators 130 are made of a conductive material. Here, the radiators 130 may include at least any one of silver (Ag), palladium (Pd), platinum (Pt), copper (Cu), gold (Au) and nickel (Ni).

Here, the radiators 130 may individually have a weight established in advance. That is, the radiators 130 have specific weights established, respectively. Here, the weight is established with a value to obtain resonant frequency, radiation coefficient, beam width and detection distance of the antenna device 100 and to make an impedance matching with it. The weight may be produced according to Taylor function or Chebyshev function.

That is, the weight may be established differently according to locations of the radiators 130. Here, two axes are defined, which intersect at the center of the feeding unit 120. One axis extends from the center of the feeding unit 120 and is parallel to the feed lines 123, and the other axis extends from the center of the feeding unit 120 and is perpendicular to the one axis. By doing this, the weights are symmetrically established based on the one axis and the other axis, with respect to the radiators 130.

Further, each of the radiators 130 is formed to have parameters determined according to each weight. Here, the parameter for the radiator 130 may determine a disposition relationship between the radiator 130 and the feeding unit 120, a size of the radiator 130 and a shape of the radiator 130. Here, the radiators 130 include first radiators 140 and second radiators 150.

The first radiators 140 are connected to the feed lines 123. By doing this, a signal is directly supplied from the feeding unit 120 to the first radiators 140.

Further, each of the first radiators 140 includes a connection unit 141 and a first radiation unit 143. Here, a parameter for each of the first radiators 140 include a length ($l_1$) and a width ($w_1$) of the first radiation unit 143.

The connection unit 141 is connected to any one of the feed lines 123. Here, the connection unit 141 is connected to the feed line 123 through one end thereof. Further, the connection unit 141 extends from the feed line 123. Here, the connection unit 141 extends in the direction different from the extension direction of the feed line 123.

Also, a signal is delivered from the feed line 123 to the connection unit 141.

The first radiation unit 143 is connected to the connection unit 141. Here, the first radiation unit 143 is connected to the other end of the connection unit 141. Here, the first radiation unit 143 is connected to the connection unit 141 through the one end thereof. Further, the first radiation unit 143 extends from the connection unit 141. Here, the first radiation unit 143 extends along the extension direction of the connection unit 141. Here, the first radiation unit 143 extends through the other end thereof. Also, the other end of the first radiation unit 143 is opened. By doing this, a signal is delivered from the connection unit 141 to the first radiation unit 143. Here, a length ($l_1$) and a width ($w_1$) of the first radiation unit 143 are defined. The length ($l_1$) of the first radiation unit 143 may correspond to the extension direction of the first radiation unit 143. The width ($w_1$) of the first radiation unit 143 may perpendicularly correspond to the extension direction of the first radiation unit 143.

The second radiators 150 are disposed apart from the feed lines 123. Further, the second radiators 150 are coupled to the feed lines 123. In other words, the second radiators 150 are electromagnetically coupled to the feed lines 123. By doing this, the second radiators 150 are in an excited state, and a signal is supplied from the feeding unit 120 to the second radiators 150. Also, each second radiator 150 includes a coupling unit 151 and a second radiator 153.

Here, parameters for each second radiator 150 include a distance (d) between the coupling unit 151 and any one of the feed lines 123, a length ($l_2$) of the coupling unit 151, a width ($w_2$) of the coupling unit 151, a length ($l_3$) of the second radiation unit 153 and a width ($w_3$) of the second radiation unit 153.

The coupling unit 151 is disposed adjacent to any one of the feed lines 123. Here, one end of the coupling unit 151 is opened. Further, at least a portion of the coupling unit 151 extends along an extension direction of the feed line 123. That is, at least a portion of the coupling unit 151 extends parallel to the feed line 123. Also, the coupling unit 151 is substantially coupled to the feed line 123. Here, a distance (d) between the coupling unit 151 and the feed line 123, a length ($l_2$) of the coupling unit 151 and a width ($w_2$) of the coupling unit 151 are defined. The distance (d) between the coupling unit 151 and the feed line 123 may correspond to a direction perpendicular to an extension direction of the feed line 123. The length ($l_2$) of the coupling unit 151 corresponds to the extension direction of the coupling unit 151. The width ($w_2$) of the coupling unit 151 may perpendicularly correspond to the extension direction of the first coupling unit 151.

The second radiation unit 153 is connected to the coupling unit 151. Here, the second radiation unit 153 is connected to the other end of the coupling unit 151. Further, the second radiation unit 153 extends from the coupling unit 151 along the extension direction of the coupling unit 151. By doing this, a signal is delivered from the coupling unit 151 to the second radiation unit 153. Here, a length ($l_3$) and a width ($w_3$) of the second radiation unit 153 are defined. The length ($l_3$) of the second radiation unit 153 may correspond to the extension direction of the second radiation unit 153. The width ($w_3$) of the second radiation unit 153 may perpendicularly correspond to the extension direction of the second radiation unit 153.

Figure 5:
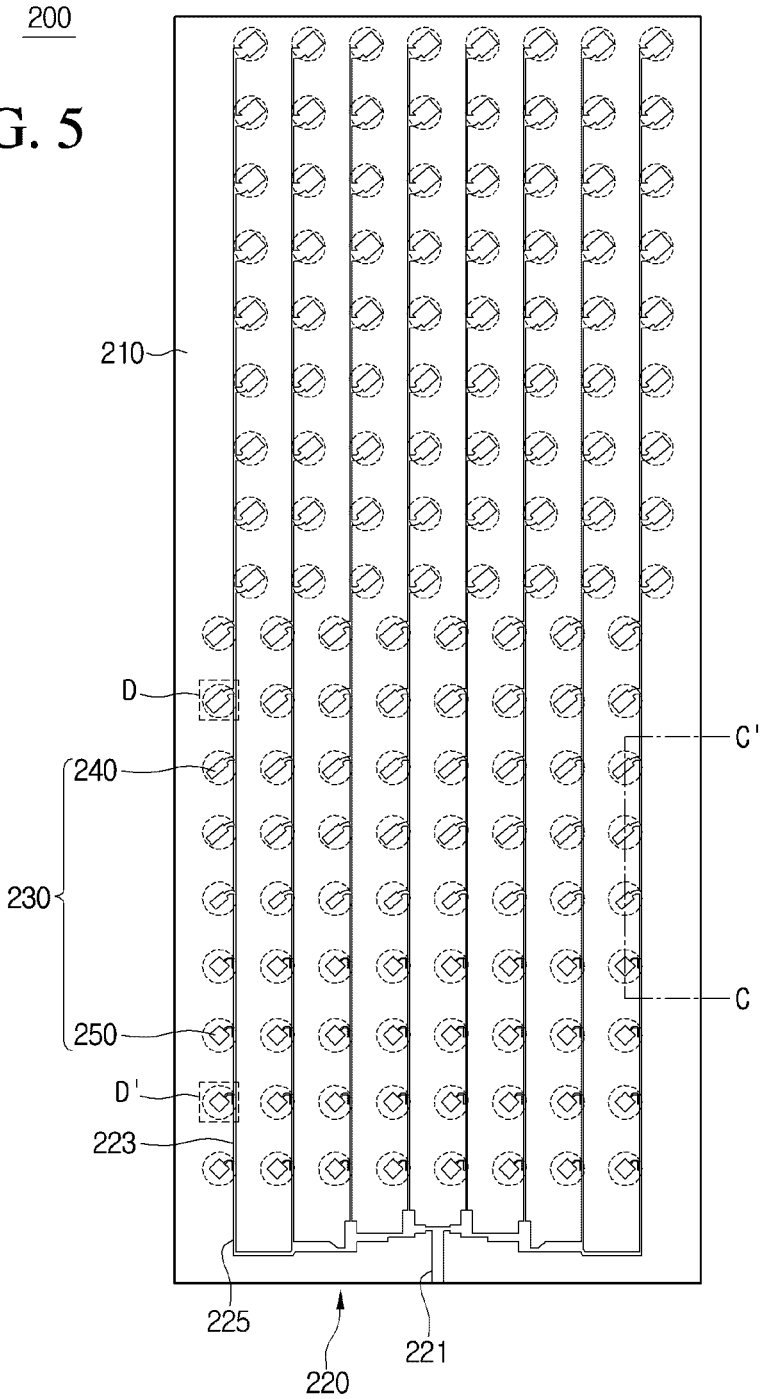
FIG. 5 is a plan view illustrating an antenna device of a radar system according to a second embodiment of the present invention.
Figure 6:
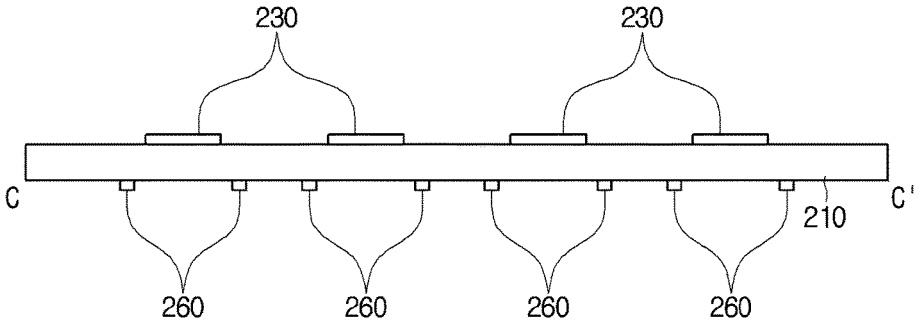
FIG. 6 is an enlarged cross-sectional view illustrating a cross-section cut along the line C-C' in FIG. 5.
Figure 7:
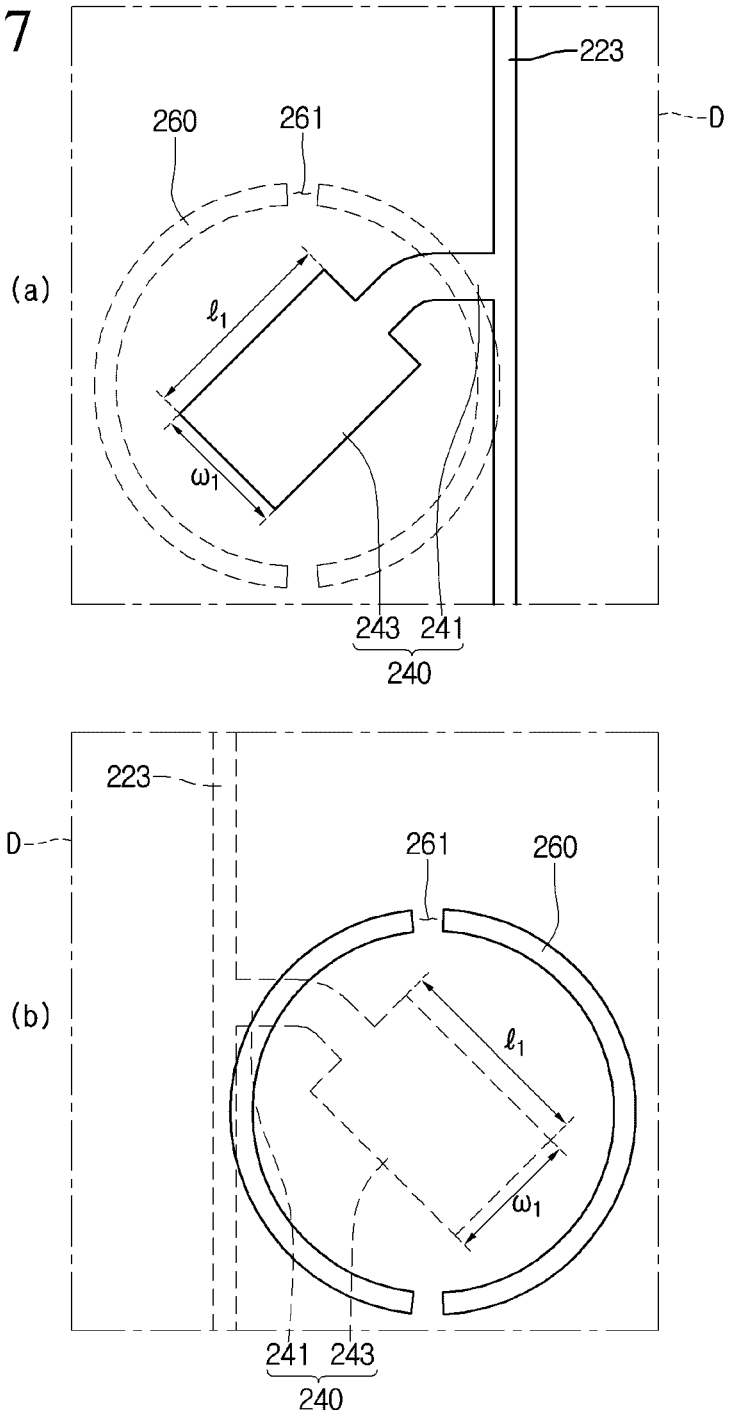
FIG. 7 is an enlarged view illustrating a region in FIG. 5.
Figure 8:
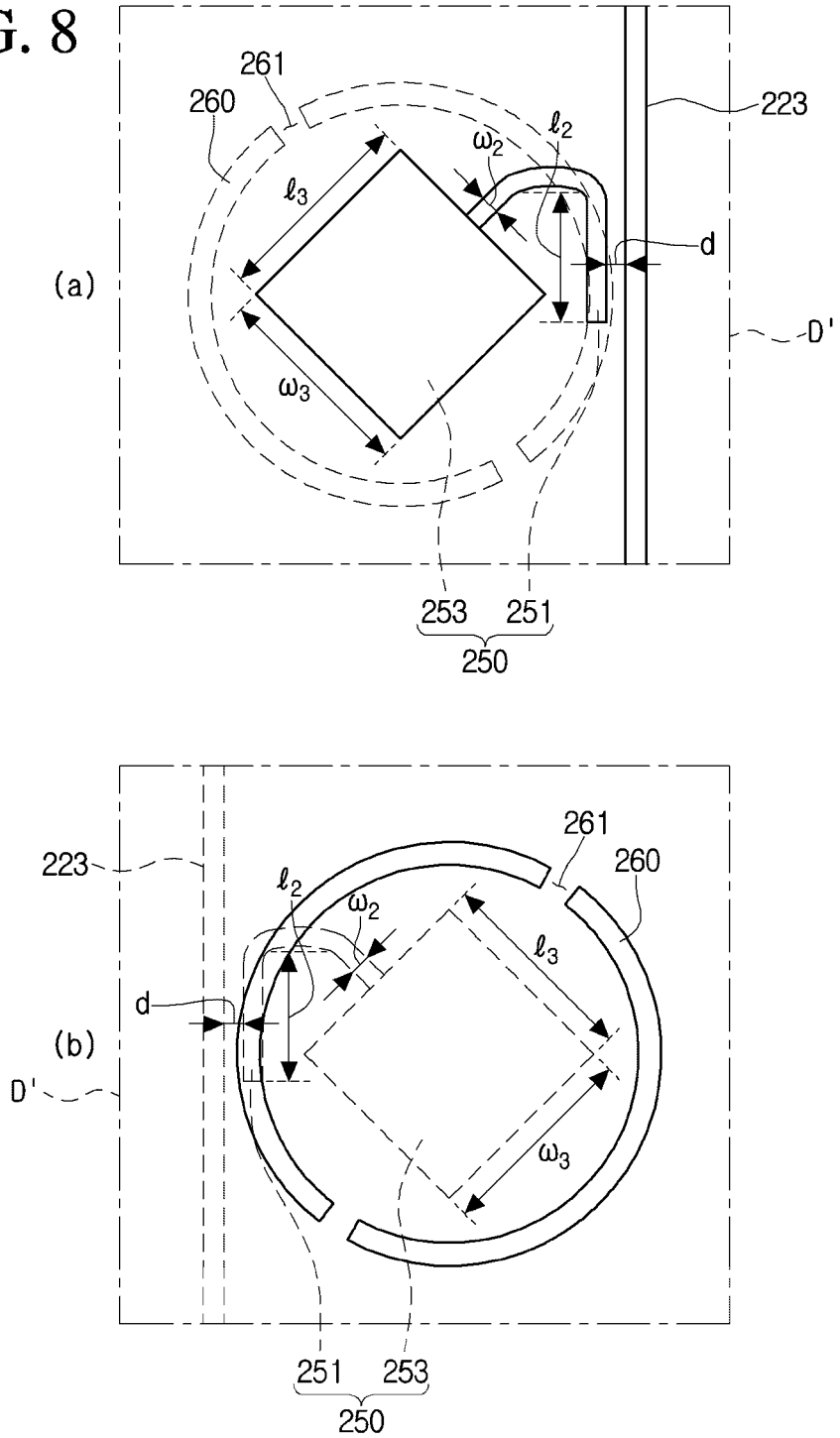
FIG. 8 is an enlarged view illustrating a D' region in FIG. 5.
Figure 9:
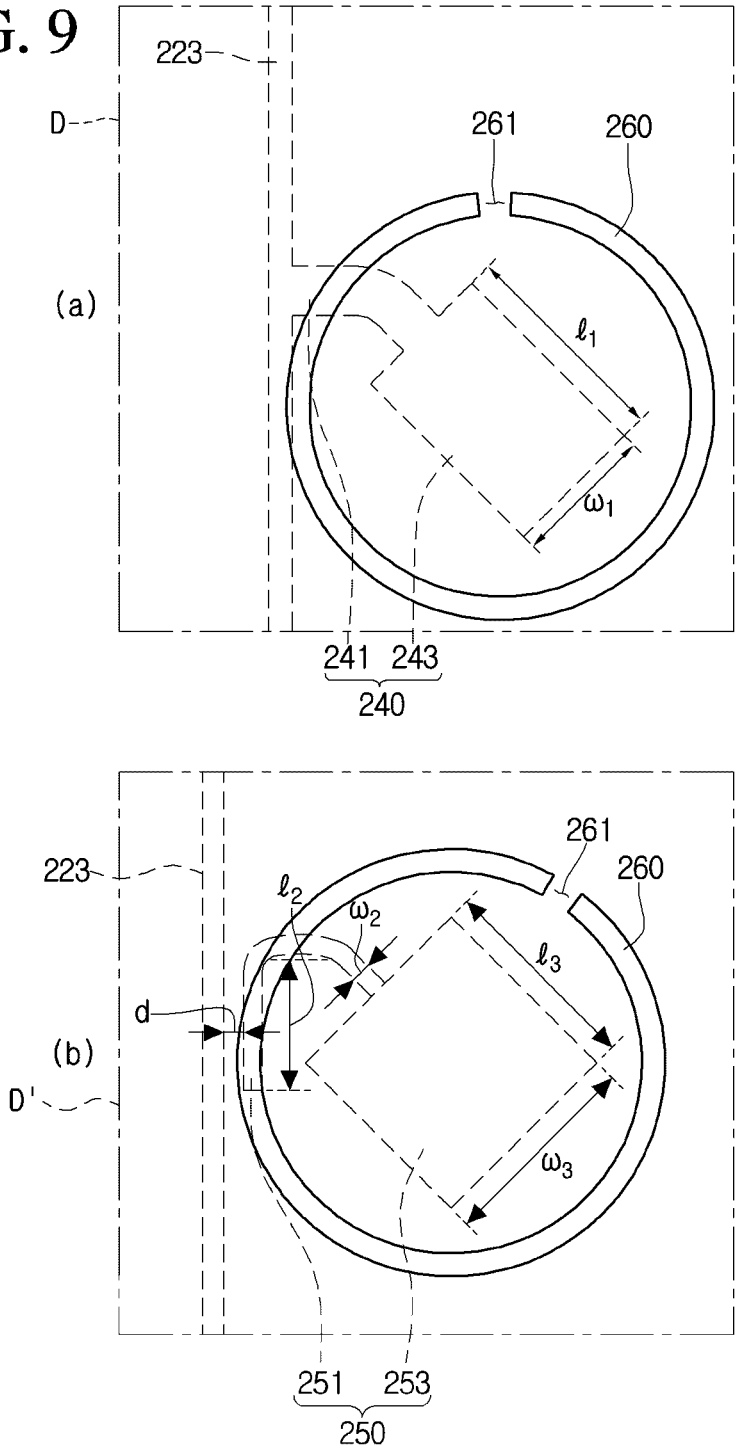
FIG. 9 is a plan view illustrating a modification of a resonator in an antenna device of a radar system according to a second embodiment of the present invention.

FIG. 5 is a plan view illustrating an antenna device of a radar system according to a second embodiment of the present invention. Further, FIG. 6 is an enlarged cross-sectional view illustrating a cross-section cut along the line C-C' in FIG. 5. Also, FIG. 7 is an enlarged view illustrating a D region in FIG. 5 and FIG. 8 is an enlarged view illustrating a D' region in FIG. 5. Here, in FIGS. 7 and 8, (A) is a plan view and (B) is a rear view. Additionally, FIG. 9 is a plan view illustrating a modification of a resonator in an antenna device of a radar system according to a second embodiment of the present invention.

Referring to FIGS. 5 to 8, in the present embodiment, an antenna device 200 of a radar system includes a substrate 210, a feeding unit 220, multiple radiators 230 and multiple resonators 260. A feed point 221 is defined in the feeding unit 220. Further, the feeding unit 220 includes a number of feed lines 223 and a distributor 225. The radiators 230 include first radiators 240 and second radiators 250. Here, each first radiator 240 includes a connection unit 241 and a first radiation unit 243. Also, each second radiator 250 includes a coupling unit 251 and a second radiation unit 253. Here, since the substrate 210, the feeding unit 220 and the radiator 230 of the present embodiment are similar to a corresponding configuration of the above-described embodiment, detailed description thereof will be omitted.

In the present embodiment, however, resonators 260 support operations of the radiators 230. That is, the resonators 260 regulate a radiation pattern of the antenna device 200. Here, the resonators 260 regulate the radiation pattern of the antenna device 200 using a higher resonant mode. Further, the resonator 260 are disposed on the lower surface of the substrate 210. Here, the resonators 260 are disposed beneath the resonators 230. Here, the resonators 260 correspond in one-to-one manner to the radiators 230. Also, the resonators 260 oppose the radiators 230, respectively. By doing this, a signal is delivered from the radiators 230 to the resonators 260. Also, the resonators 260 are made of a conductive material. Here, the resonators 260 may include at least any one of silver (Ag), palladium (Pd), platinum (Pt), copper (Cu), gold (Au) and nickel (Ni).

Further, the resonators 260 each have a shape of ring. Here, each resonator 260 surrounds a first radiation unit 243 or a second radiation unit 253. In other words, the first radiation unit 243 or the second radiation unit 253 is disposed inside each resonator 260. Here, at least a portion of the resonator 260 may be overlapped with the connection unit 241 or the coupling unit 251 in the up and down direction.

Further, each resonator 260 has two slits 261 formed therein. That is, each resonator 260 is opened by the slits 261. Here, the slits 261 are disposed opposite each other in each resonator 260. That is, the slits 261 are disposed on a straight line passing through a center of each resonator 260. Here, each resonator 260 is separated into two resonance units by the slits 261. Here, the magnitude of electric field may be highest in both ends and the center of each resonance unit.

Here, the thickness of the resonators 260 is determined as a value for an impedance matching of the antenna deice 200. That is, the thickness of the resonators 260 may be determined as a value for 50Ω impedance matching, for example. Further, the perimeter length of the resonators 260 is determined by a wavelength λ corresponding to a resonant frequency band of the antenna device 200. That is, the perimeter length of the resonators 260 may be determined as the following equation 1.

$$2\pi r = n\lambda_g,\ n=2, 4, 6, \ldots,\ \lambda_g = \lambda/\in \qquad \text{[Equation 1]}$$

Here, r denotes a radius of the resonators 260 and ∈ denotes a dielectric permittivity of the substrate 210.

In the present embodiment, additionally, the radiators 230 and the resonators 260 individually have weights that are established in advance. That is, a specific weight is established with respect to each radiator 230 and its corresponding resonator 260. Here, the weight is established with a value to obtain resonant frequency, radiation coefficient, beam width and detection distance of the antenna device 220 and to make an impedance matching with it. The weight may be produced according to Taylor function or Chebyshev function.

That is, the weight is established differently according to locations of the radiators 230 and the resonators 260. Here, two axes are defined, which intersect at the center of the feeding unit 220. One axis extends from the center of the feeding unit 220 and is parallel to the feed lines 223, and the other axis extends from the center of the feeding unit 220 and is perpendicular to the one axis. By doing this, the weight is symmetrically established based on the one axis and the other axis, with respect to the radiators 230 and the resonators 260.

Further, each radiator 230 and its facing resonator 260 are formed of parameters determined according to each weight. Here, the parameters for the radiator 230 and its facing resonator 260 may be used to determine a disposition relationship between the radiator 230 and the feeding unit 220, a size of the radiator 230, a shape of the radiator 230 and locations of the slits 261 in the resonator 260.

Here, the parameters for the first radiator 240 and its facing resonator 260 include a length ($l_1$) of the first radiation unit 243, a width ($w_1$) of the first radiation unit 243 and locations of the slits 261 in the resonator 260. The length ($l_1$) of the first radiation unit 243 corresponds to an extension direction of the first radiation unit 243. The width ($w_1$) of the first radiation unit 243 perpendicularly corresponds to the extension direction of the first radiation unit 243. The locations of the slits 261 may be expressed with coordinates on a plane that is formed of a vertical axis passing through the center of the resonator 260 and parallel to the feed lines 223 and a horizontal axis passing through the center of the resonator 260 and perpendicular to the vertical axis.

Further, parameters for the second radiator 250 and its facing resonator 260 include a distance (d) between the coupling unit 251 and any one of the feed lines 223, a length ($l_2$) of the coupling unit 251, a width ($w_2$) of the coupling unit 251, a length ($l_3$) of the second radiation unit 253, a width ($w_3$) of the second radiation unit 253, and locations of the slits 261 in the resonator 260. The length ($l_2$) of the coupling unit 251 corresponds to the extension direction of the coupling unit 251. The width ($w_2$) of the coupling unit 251 may perpendicularly correspond to the extension direction of the coupling unit 251. The length ($l_3$) of the second radiation unit 253 may correspond to the extension direction of the second radiation unit 253. The width ($w_3$) of the second radiation unit 253 may perpendicularly correspond to the extension direction of the second radiation unit 253. The locations of the slits 261 may be expressed with coordinates on a plane that is formed of a vertical axis passing through the center of the resonator 260 and parallel to the feed lines 223 and a horizontal axis passing through the center of the resonator 260 and perpendicular to the vertical axis.

Meanwhile, in the present embodiment, an example where two slits 261 are formed in each resonator 260 is disclosed, which is not limited thereto. That is, although the two slits 261 are not formed in each resonator 260, the present invention may be embodied. For example, as illustrated in FIG. 9, one slit 261 may be formed in each resonator 260. Here, the magnitude of the electric field may be highest in both ends and the center of the resonator 260. However, when one slit 261 is formed in each resonator 260, a perimeter length of the resonator 260 may be determined as the following equation 2.

$$2\pi r = n\lambda_g,\ n=1, 3, 5, \ldots,\ \lambda_g = \lambda/\in \qquad \text{[Equation 2]}$$

Figure 10:
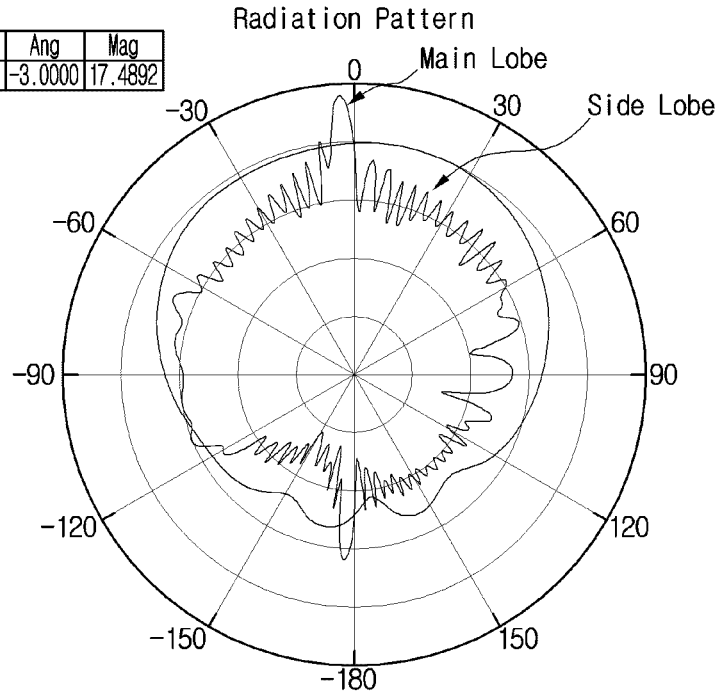
FIG. 10 is a graph for explaining an operation characteristic of an antenna device according to embodiments of the present invention.
Figure 10:
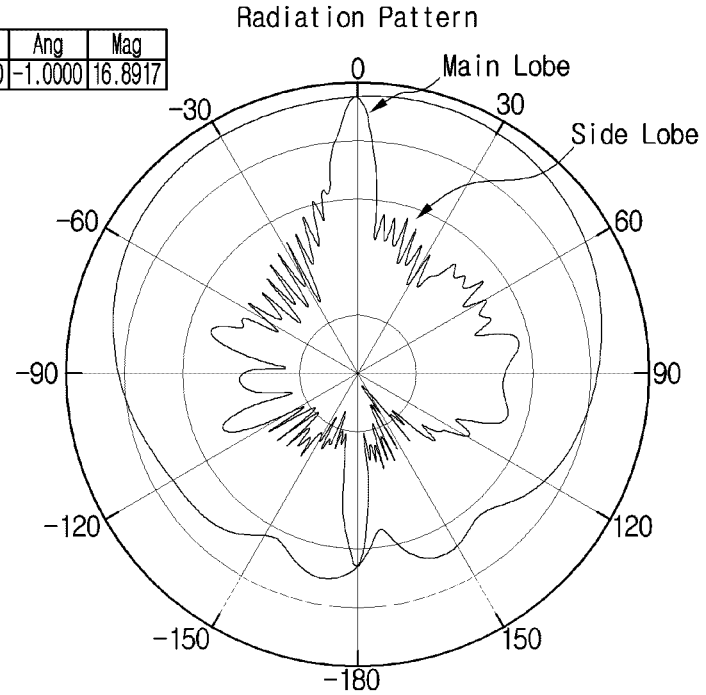

FIG. 10 is a graph for explaining an operation characteristic of an antenna device according to embodiments of the present invention. Here, FIG. 10(A) illustrates a radiation pattern of an antenna device according to a first embodiment of the present invention, and FIG. 10(B) illustrates a radiation pattern of an antenna device according to a second embodiment of the present invention.

Referring to FIG. 10, the radiation pattern of the antenna device 100 according to the first embodiment of the present invention and the radiation pattern of the antenna device 200 according to the second embodiment of the present invention each appear as a main lobe and a side lobe. Here, the main lobe is a region where signals are emitted in concentration. The side lobe is a region other than the main lobe, meaning a region where signals are emitted minutely. Also, the side lobe is regarded as an interference region.

Here, the width of a main lobe of the antenna device 200 according to the second embodiment of the present invention is broader than that of a main lobe of the antenna device 100 according to the first embodiment of the present invention. This means that signals are concentrated to a broader region in the antenna device 200 according to the second embodiment of the present invention, compared with the antenna device 100 according to the first embodiment of the present invention. Meanwhile, the width of the side lobe of the antenna device 200 according to the second embodiment of the present invention is narrower than that of the side lobe of the antenna device 100 according to the first embodiment of the present invention. This means that the interference in the antenna device 200 according to the second embodiment of the present invention is more restricted, compared with the antenna device 100 according to the first embodiment of the present invention. In other words, as the antenna device 200 according to the second embodiment of the present invention includes the resonators 260, the antenna device 200 has a more enhanced performance, compared with the antenna device 100 according to the first embodiment of the present invention.

Meanwhile, in the above-described embodiments, an example where the radiators 130 and 230 include first radiators 140 and 240 and second radiators 150 and 250 is disclosed, which is not limited thereto. That is, even though the radiators 130 and 230 do not include the first radiators 140 and 240 and second radiators 150 and 250, it may be possible to embody the present invention. Specifically, the radiators 130 and 230 may be formed of the first radiators 140 and 240. Here, the radiators 130 and 230 may both be connected to the feed lines 123 and 223. Also, the radiators 130 and 230 may be formed of the second radiators 150 and 250. Here, the radiators 130 and 230 may both be disposed apart from the feed lines 123 and 223.

Figure 11:
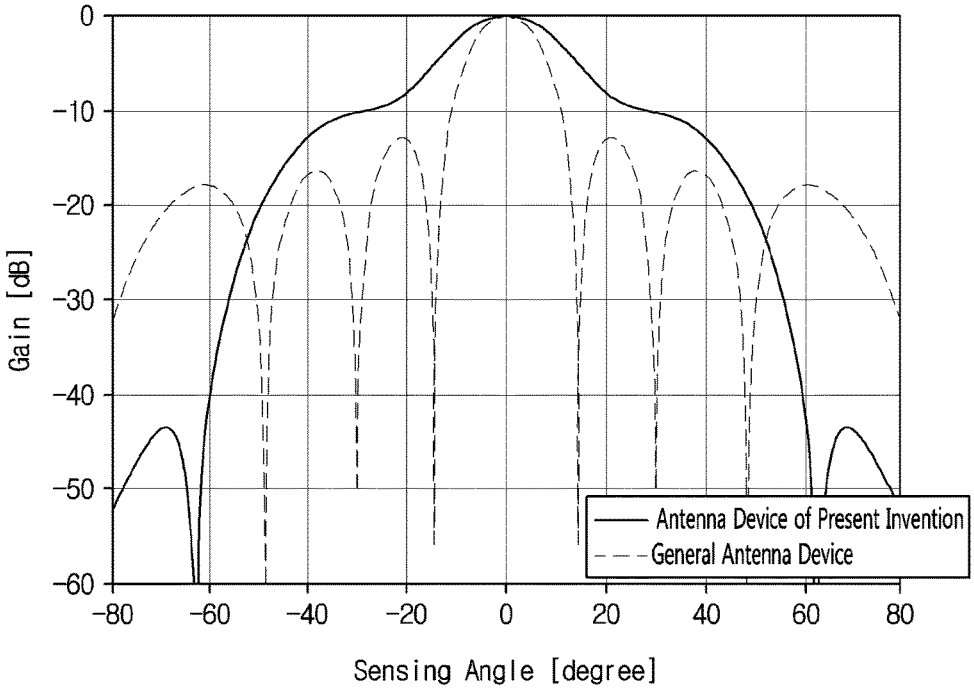
FIG. 11 is a graph for explaining a gain for each sensing angle of an antenna device according to embodiments of the present invention.

FIG. 11 is a graph for explaining a gain for each sensing angle of an antenna device according to embodiments of the present invention. Here, the gain indicates a degree that signals are emitted in concentration, correspondingly to a desired direction in the antenna device. Further, FIG. is exemplary views illustrating the beam width of an antenna device according to embodiments of the present invention.

Referring to FIG. 11, the width of a main lobe of the antenna devices 100 and 200 according to the embodiments of the present invention is broader than that of a main lobe of a general antenna device (not illustrated). This means that signals are concentrated to a broader region in the antenna devices 100 and 200 according to the embodiments of the present invention, compared with the general antenna device of the present invention. Meanwhile, the width of the side lobe of the antenna devices 100 and 200 according to the embodiments of the present invention is narrower than that of the side lobe of the general antenna device. That is, a null section is formed between −20 degree and 20 degree, correspondingly to the general antenna device. On the contrary, in the antenna devices 100 and 200 according to the present invention, a null section is filled between −60 degree to 60 degree, so that the side lobe is suppressed. It means that an interference is more suppressed in the antenna devices 100 and 200 according to the embodiments of the present invention, compared with the general antenna device.

Figure 12:
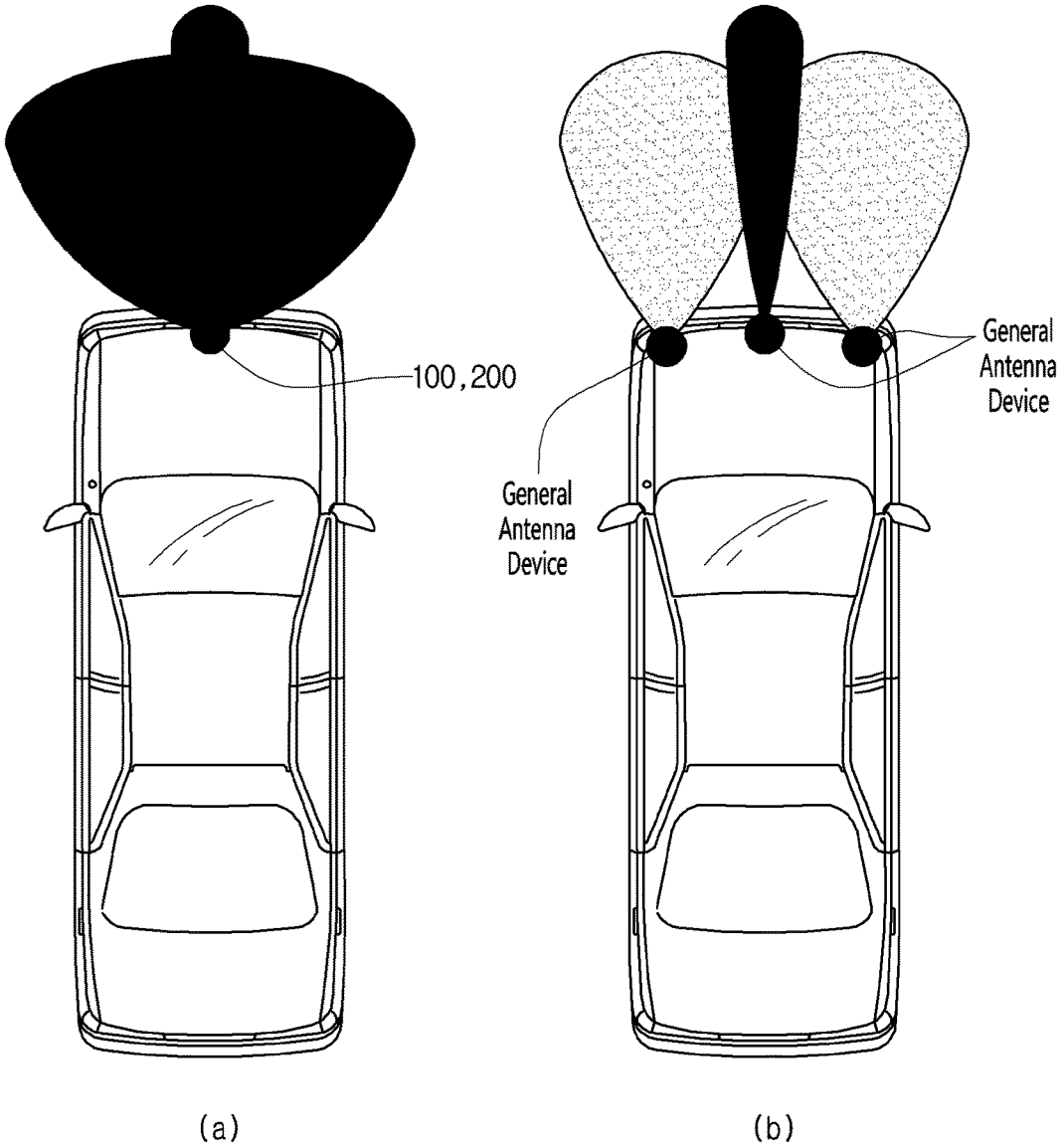
FIG. 12 is exemplary views illustrating the beam width of an antenna device according to embodiments of the present invention.

That is, the antenna devices 100 and 200 according to the embodiments of the present invention have a broader detection coverage and a longer detection distance, compared with the general antenna device. In other words, the antenna devices 100 and 200 according to the embodiments of the present invention have a more expanded beam width. In addition, the antenna devices 100 and 200 according to the embodiments of the present invention have a variety of detection distances. Accordingly, the radar system according to the embodiments of the present invention includes an antenna device 100 or 200 as illustrated in FIG. 12(A), thereby capable of obtaining a desired detection coverage and detection distance. On the other hand, the general radar system has to include a number of antenna devices as illustrated in FIG. 12(B), in order to obtain a desired detection coverage and detection distance.

According to the present invention, as the radiators 130 and 230 are formed according to their weights, a uniform performance of the radiators 130 and 230 may be obtained. By doing this, desired resonant frequency and radiation coefficient may be obtained for the radiators 130 and 230, and an impedance matching is performed in the radiators 130 and 230 without a separate construction. Further, the beam width of the antenna devices 100 and 200 may be more enlarged. In addition, a variety of detection distances may be embodied in one antenna device 100 or 200. By doing this, the radar system includes one antenna device 100 or 200, so that a desired detection coverage may be obtained. In other words, a detection coverage of the radar system may be expanded without enlarging the radar system. Accordingly, the performance of the radar system may be enhanced. Further, a manufacturing cost of the radar system may be reduced.

Meanwhile, the embodiments of the present invention disclosed in the specification and drawings are presented as specific examples only, in order not to restrict the scope of the invention but to describe technical details of the present invention with ease and to help the understanding of the present invention. That is, it is obvious to those skilled in the art that other various modifications based on the technical ideas of the present invention may be embodied.

The invention claimed is:

1. An antenna device, comprising:

a substrate;

a radiator arranged on an upper surface of the substrate and including a plurality of first radiators and a plurality of second radiators;

a feeding unit configured to supply the plurality of first radiators and the plurality of second radiators with a signal; and a plurality of resonators arranged on a lower surface of the substrate and placed correspondingly to the plurality of first radiators and the plurality of second radiators, wherein the plurality of first radiators and the plurality of second radiators extend in one direction and are disposed on the substrate, wherein the plurality of the first radiators are connected to feed lines and each of the plurality of first radiators includes a first radiation unit and a connection unit, wherein each of the plurality of the second radiators is spaced apart from the feed lines, and each of the plurality of the second radiators includes a second radiation unit and a coupling unit for electromagnetic coupling to at least one of the feed lines, wherein the first radiation unit in each of the plurality of first radiators is formed with parameters including a length of the first radiation unit and a width of the first radiation unit, wherein the second radiation unit in each of the plurality of second radiators is formed with parameters including a separation distance between the coupling unit and a corresponding feed line among the feed lines, a length of the coupling unit, a width of the coupling unit, a length of the second radiation unit and a width of the second radiation unit, and wherein the plurality of first radiators, the plurality of second radiators and the plurality of resonators have weights corresponding thereto, respectively.

2. The antenna device of claim 1, wherein each of the plurality of resonators has at least one slit, each of the plurality of resonators being opened by the corresponding at least one slit.

3. The antenna device of claim 2, wherein each of the plurality of resonators has two slits and the two slits are opposite to each other and divide the resonator into two resonance units.

4. The antenna device of claim 3, wherein a perimeter length of each resonator among the plurality of resonators is determined by a wavelength corresponding to a resonant frequency band of the antenna device.

5. The antenna device of claim 1, wherein a weight is established with a value with which the corresponding radiator among the plurality of first radiators and the plurality of second radiators obtains a resonant frequency, a radiation coefficient, a beam width and a detection distance and an impedance matching is performed.

6. The antenna device of claim 1, wherein a weight is symmetrically established based on two axes that are orthogonal each other at a center of the feeding unit.

7. The antenna device of claim 6, wherein one of the two axes extends from the center of the feeding unit and is parallel to a feed line, and the other axis of the two axes extends from the center of the feeding unit and is perpendicular to the one of the two axes.

8. The antenna device of claim 1, wherein each coupling unit in the plurality of second radiators has an end opened, and has at least a portion extending along an extension direction of a corresponding feed line among the feed lines.

9. The antenna device of claim 1, wherein a thickness of each of plurality of first radiators and the plurality of second radiators is determined as a value to perform an impedance matching of the antenna device.

10. The antenna device of claim 1, wherein the feeding unit includes a number of feed lines and distributors.

* * * * *